US011787662B2

(12) United States Patent
Zhang et al.

(10) Patent No.: US 11,787,662 B2
(45) Date of Patent: Oct. 17, 2023

(54) GOVERNOR ASSEMBLY AND ELEVATOR

(71) Applicant: Otis Elevator Company, Farmington, CT (US)

(72) Inventors: Ming Zhang, Shanghai (CN); Yong Zhao, Shanghai (CN); Wei Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 14 days.

(21) Appl. No.: 17/388,770

(22) Filed: Jul. 29, 2021

(65) Prior Publication Data

US 2022/0144587 A1 May 12, 2022

(30) Foreign Application Priority Data

Nov. 6, 2020 (CN) ..... 202011230116.6

(51) Int. Cl.
*B66B 5/04* (2006.01)

(52) U.S. Cl.
CPC ..... *B66B 5/044* (2013.01)

(58) Field of Classification Search
CPC ..... B66B 5/044; B66B 5/04; B66B 7/062
See application file for complete search history.

(56) References Cited

U.S. PATENT DOCUMENTS 6,202,795 B1 * 3/2001 Bluteau ..... B66B 5/04 187/287
2007/0221452 A1 9/2007 Aguirre et al.
2013/0306409 A1 11/2013 Dube et al.
2015/0136544 A1 * 5/2015 Dube ..... B66B 5/044 464/77

FOREIGN PATENT DOCUMENTS

EP 2913287 A1 * 9/2015 ..... B66B 5/044
WO WO-2016016680 A1 * 2/2016 ..... B66B 11/0246

OTHER PUBLICATIONS

European Search Report for Application No. 21206802.7; dated Mar. 30, 2022; 9 Pages.

* cited by examiner

*Primary Examiner* — Diem M Tran
(74) *Attorney, Agent, or Firm* — CANTOR COLBURN LLP

(57) ABSTRACT

A governor assembly and an elevator. The governor assembly includes: a body equipping with a trigger wheel and a guide wheel, the trigger wheel and the guide wheel being arranged to be rotatable relative to the body; a guide member extending around the trigger wheel and the guide wheel in sequence; and wherein the cross section of the guide member has a first dimension in the direction facing the trigger wheel or the guide wheel, and has a second dimension in the radial direction of the trigger wheel or the guide wheel, and wherein the first dimension is larger than the second dimension.

8 Claims, 3 Drawing Sheets

GOVERNOR ASSEMBLY AND ELEVATOR

FOREIGN PRIORITY

This application claims priority to Chinese Patent Application No. 202011230116.6, filed Nov. 6, 2020, and all the benefits accruing therefrom under 35 U.S.C. § 119, the contents of which in its entirety are herein incorporated by reference

TECHNICAL FIELD

The present application relates to the field of elevator structure. More specifically, the present application relates to a governor assembly. The present application also relates to an elevator including the above governor.

BACKGROUND

A governor is usually arranged in an elevator, and includes a plurality of pulleys associated with a steel wire rope. According to elevator design standards, the diameter of the pulley used for the steel wire rope of the governor should be at least 30 times the nominal diameter of the rope. A typical steel wire rope is formed by twisting a multiple of strands around a core, and there are undulations over the outer surface of the steel wire rope.

SUMMARY

An object of one aspect of the present application is to provide a governor assembly, which aims to provide a new structural solution for the governor. An object of another aspect of the present application is to provide an elevator including the above-mentioned governor assembly.

The objects of the present application are achieved through the following technical solutions.

A governor assembly, comprising:

a body equipping with a trigger wheel and a guide wheel, and the trigger wheel and the guide wheel being arranged to be rotatable relative to the body;

a guide member extending around the trigger wheel and the guide wheel in sequence; and wherein the cross section of the guide member has a first dimension in the direction facing the trigger wheel or the guide wheel, and has a second dimension in the radial direction of the trigger wheel or the guide wheel, and wherein the first dimension is larger than the second dimension.

In the governor assembly described above, optionally, the guide member includes a plurality of bearing members and a covering layer wrapping each of the bearing members.

In the governor assembly described above, optionally, the covering layer is capable of transmitting the force from the trigger wheel and the guide wheel to the bearing members, such that the movement of the body relative to the bearing members is stopped.

In the governor assembly described above, optionally, the bearing members are made of one or more of the following materials: metal, carbon fiber.

In the governor assembly described above, optionally, the bearing members are arranged to be separated from each other, and the covering layer is provided between the adjacent bearing members.

In the governor assembly described above, optionally, the covering layer defines a first surface in contact with the trigger wheel and a second surface in contact with the guide wheel.

In the governor assembly described above, optionally, the first surface and the second surface are configured to be symmetrical with respect to a first axis.

In the governor assembly described above, optionally, the bearing members are arranged along the first axis.

In the governor assembly described above, optionally, the first surface and the second surface are configured to be parallel to each other.

In the governor assembly described above, optionally, the distances from the first surface and the second surface to the first axis are configured to vary along the first axis.

In the governor assembly described above, optionally, the distance between the first surface and the second surface is configured to be larger than or equal to 3 mm and smaller than 6 mm.

In the governor assembly described above, optionally, one end of the guide member is attached to the top of an elevator hoistway, the other end of the guide member is attached to the bottom of the elevator hoistway, and the body is attached to an elevator car.

In the governor assembly described above, optionally, the direction in which the guide member surrounds the trigger wheel is opposite to the direction in which the guide member surrounds the guide wheel.

In the governor assembly, optionally, the trigger wheel and the guide wheel are configured to have a diameter larger than or equal to 90 mm and smaller than 180 mm.

An elevator comprising the governor assembly described above.

BRIEF DESCRIPTION OF THE DRAWINGS

The present application will be described below in further detail with reference to the accompanying drawings and preferred embodiments. Those skilled in the art will appreciate that these drawings are drawn only for the purpose of explaining the preferred embodiments, and thus should not be construed as limiting the scope of the present application. In addition, unless specifically stated, the drawings are only intended to conceptually represent the composition or construction of the described objects and may contain exaggerated illustration. The drawings are not necessarily drawn to scale.

DETAILED DESCRIPTION

Figure 1:
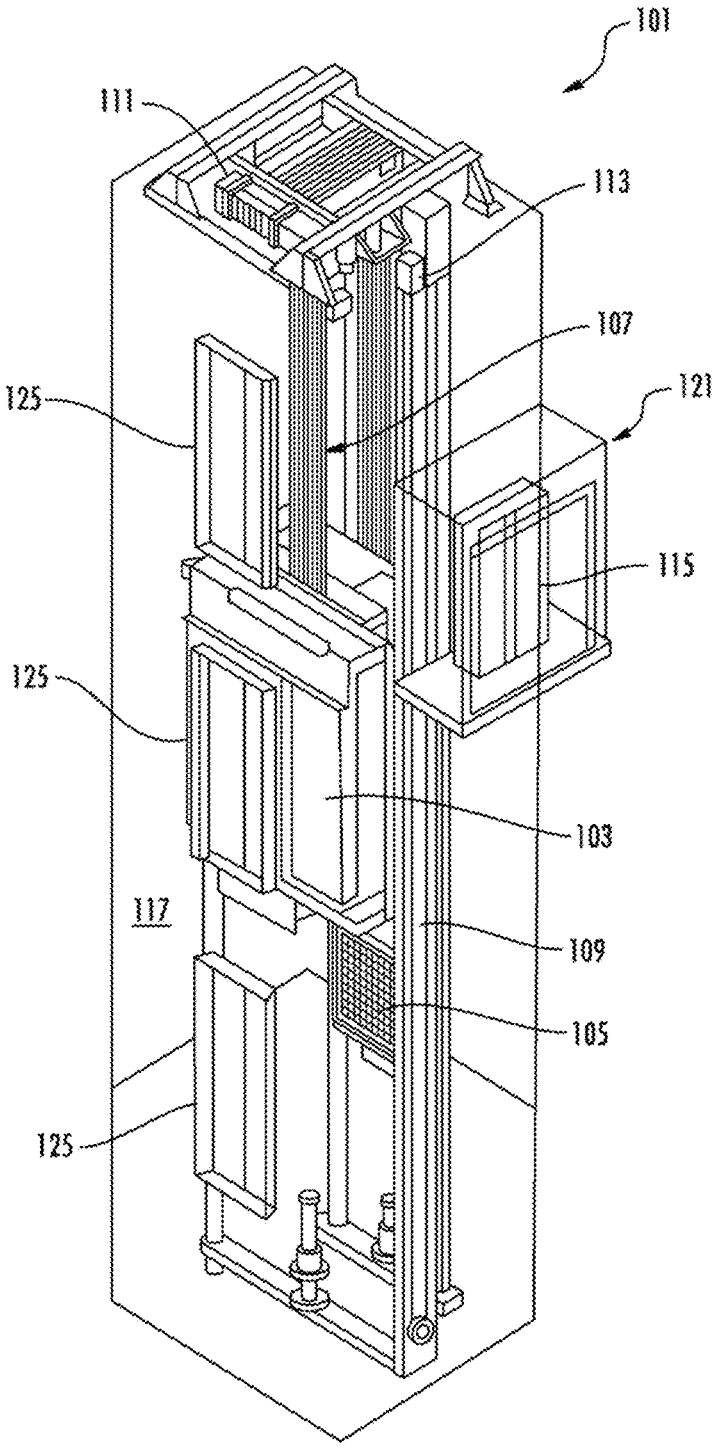
FIG. 1 is a structural schematic view of an elevator.

Hereinafter, preferred embodiments of the present application will be described in detail with reference to the accompanying drawings. Those skilled in the art will appreciate that these descriptions are merely illustrative and exemplary, and should not be construed as limiting the scope of protection of the present application.

Firstly, it should be noted that the orientational terms such as top, bottom, upward, and downward mentioned herein are defined with respect to the directions in various drawings.

These orientations are relative concepts, and therefore will vary with the position and state thereof. Accordingly, these or other orientational terms should not be interpreted as restrictive.

In addition, it should also be noted that for any single technical feature described or implied in the embodiments herein, or any single technical feature shown or implied in the drawings, it is still possible to combine these technical features (or their equivalents) so as to obtain other embodiments that are not directly mentioned herein.

It should be noted that in different drawings, identical or substantially identical components are denoted by identical reference signs.

FIG. 1 is a structural schematic view of an elevator. An elevator system 101 includes a series of parts installed in a hoistway 117 which may be arranged across multiple floors 125, and an elevator door may be provided at each floor 125, respectively. The elevator system 101 includes: a car 103, a counterweight 105, traction wires 107, a guide rail 109, a drive device 111, a position detection system 113, and a controller 115, etc. One end of the traction wire 107 is attached to the car 103, and the other end of the traction wire 107 is attached to the counterweight 105. The counterweight 105 is used to balance the weight of the car 103, and the traction wire 107 is actuated by the movement of the drive device 111, so as to selectively change the position of the car 103 and make the car 103 stop at a desired floor. The traction wire 107 may be, for example, a rope, a steel cable, a steel belt with a covering layer, and so on. The traction wire 107 may also include a pulley mechanism or pulley block (not shown) to achieve desired raising and lowering operations. It is easy to understand that the car 103 is also correspondingly provided with a door for personnel to enter and exit the car 103.

The drive device 111 is provided at the top of the hoistway 117 and is configured to adjust the positions of the car 103 and the counterweight 105. The drive device 111 can be any suitable power supply device, including but not limited to an electric motor, etc. The drive device 111 may be powered by a power line or power grid (not shown).

The position detection system 113 can be installed to be fixed relative to the hoistway 117, and is preferably arranged at the top of the hoistway 117; for example, it can be installed on a bracket or guide rail. The position detection system 113 is also configured to sense the position of the car 103 within the hoistway 117, so as to provide a position signal related to the position of the car 103. In another embodiment, the position detection system 113 may also be arranged on other parts, such as on a moving part. The position detection system 113 may include an encoder, a sensor, or other suitable sensing systems, and the sensing method includes but not limited to speed sensing, relative position sensing, absolute position sensing, digital encoding sensing, and so on.

The controller 115 may be arranged in an independent control room 121, or may also be arranged at other suitable positions. In an embodiment, the controller 115 may also be arranged at a remote location or in the cloud. The controller 115 is configured to control the operation of the entire elevator system 101. For example, the controller 115 can adjust the operation of the drive device 111 so as to make the car 103 and the counterweight 105 start, accelerate, decelerate, stop, etc. The controller 115 may perform control operations according to the signal from the position detection system 113. In an embodiment, the controller 115 is configured to stop the car 103 at one of the each floor 125 and perform acceleration or deceleration movement between the floors 125.

Figure 2:
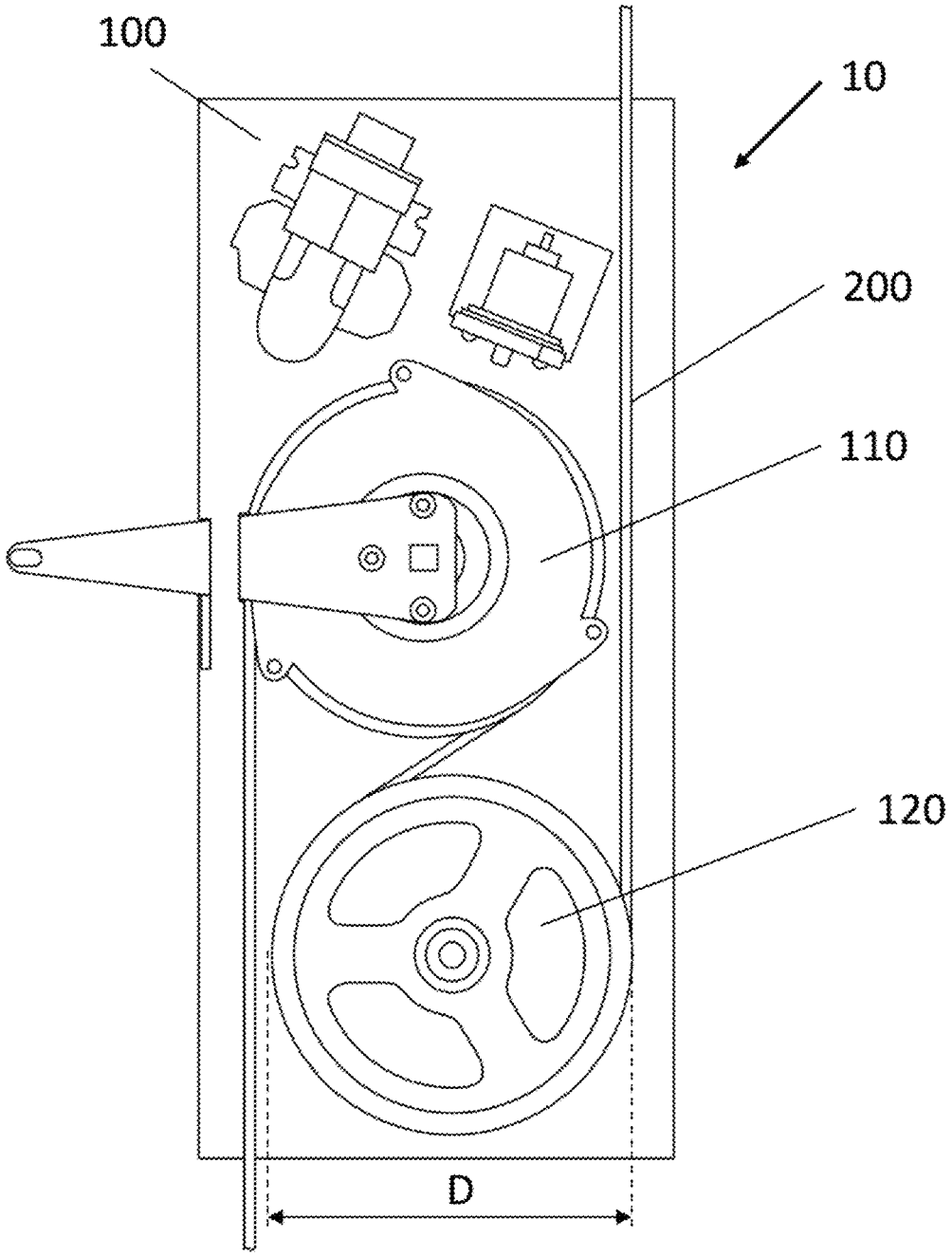
FIG. 2 is a perspective view of a governor assembly according to an embodiment of the present application.

FIG. 2 is a perspective view of a governor assembly according to an embodiment of the present application. The governor assembly 10 includes a body 100 configured to be installed to the car 103 of the elevator system 101 such as the one shown in FIG. 1. The body 100 is provided with a trigger wheel 110 and a guide wheel 120. In the illustrated embodiment, the trigger wheel 110 is arranged above the guide wheel 120, and both the trigger wheel 110 and the guide wheel 120 are configured to be rotatable relative to the body 100. In addition, the rotation centers of the trigger wheel 110 and the guide wheel 120 may be arranged along the same vertical line.

A guide member 200 is also schematically shown in FIG. 2. One end of the guide member 200 is attached to the top of the hoistway 117 (not shown), and the other end of the guide member 200 is attached to the bottom of the hoistway 117 (not shown). The guide member 200 extends around the trigger wheel 110 and the guide wheel 120 in sequence. In the illustrated embodiment, the guide member 200 extends around the trigger wheel 110 in the clockwise direction, and extends around the guide wheel 120 in the counterclockwise direction. For example, the direction in which the guide member 200 extends around the trigger wheel 110 is opposite to the direction in which the guide member 200 extends around the guide wheel 120.

Furthermore, in an embodiment, the guide member 200 is configured to have a dimension larger than 3 mm and smaller than 6 mm in the radial direction of the trigger wheel 110 or the guide wheel 120. As used herein, the dimension of the guide member in the radial direction refers to the dimension of the guide member 200 measured in the radial direction of the trigger wheel 110 or the guide wheel 120 from the surface of the trigger wheel 110 or the guide wheel 120. In order to meet the dimensional relationship of at least 30 times requirement for the elevator design specification, the trigger wheel 110 or the guide wheel 120 may have a diameter D larger than or equal to 90 mm and smaller than 180 mm. In an embodiment, the diameters of the trigger wheel 110 and the guide wheel 120 may be equal to each other. In another embodiment, the diameters of the trigger wheel 110 and the guide wheel 120 may be not equal to each other.

By adopting the dimension of the guide member and the dimensions of the trigger wheel 110 and the guide wheel 120 in the present application, the dimension of the space occupied by the trigger wheel 110 and the guide wheel 120 can be effectively reduced, thereby providing more space for installaing or arranging other parts. In addition, the spacing between the trigger wheel 110 and the guide wheel 120 required to reduce the risk of bending fatigue of the guide member can also be reduced. The above change of dimensions can reduce the overall dimension of the governor assembly 10, thereby improving the space utilization. In addition, the reduced dimensions of the trigger wheel 110 and the guide wheel 120 also reduces the manufacturing cost.

In an embodiment, as the car 117 moves, the trigger wheel 110 and the guide wheel 120 rotate, so that the body 100 of the governor assembly 10 moves relative to the guide member 200. The guide member 200 may be configured to be fixed relative to the hoistway 117, while the body 100 is movable relative to the hoistway 117.

Figure 3:
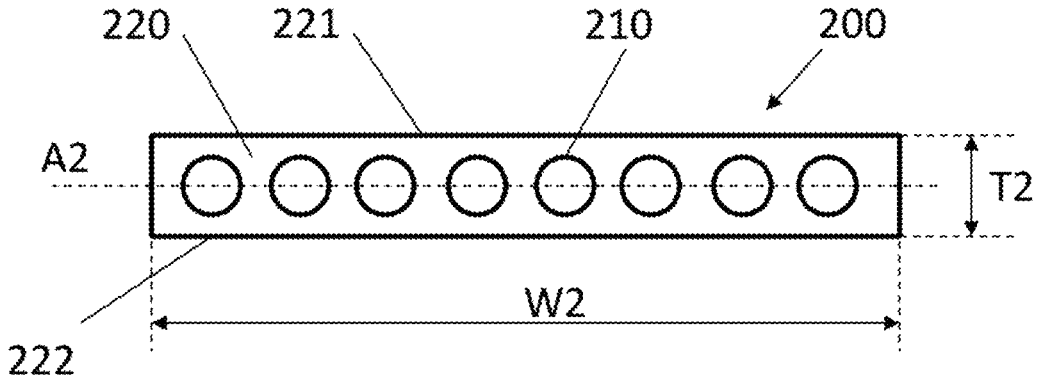
FIG. 3 is a cross-sectional schematic view of a guide member according to an embodiment of the present application.
Figure 4:
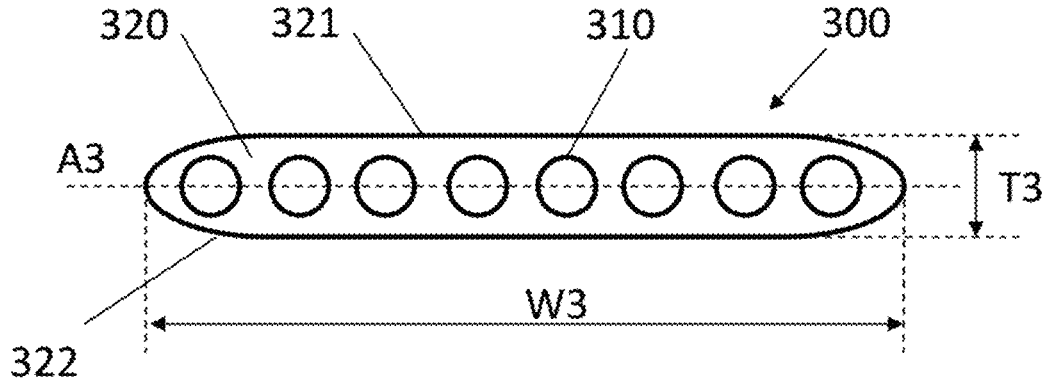
FIG. 4 is a cross-sectional schematic view of a guide member according to another embodiment of the present application.
Figure 5:
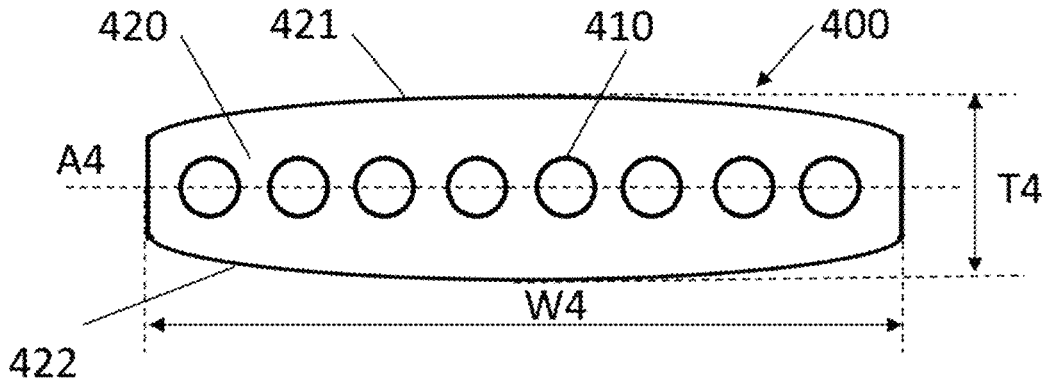
FIG. 5 is a cross-sectional schematic view of a guide member according to yet another embodiment of the present application.

FIG. 3 is a cross-sectional schematic view of a guide member according to an embodiment of the present application, FIG. 4 is a cross-sectional schematic view of a guide member according to another embodiment of the present application, and FIG. 5 is a cross-sectional schematic view of a guide member according to yet another embodiment of the present application. As shown in FIG. 3, the guide member 200 may have a substantially rectangular cross section. For example, the guide member 200 has a lengthwise dimension or a first dimension W2, and a widthwise dimension or a second dimension T2, and the first dimension is larger than the second dimension. More specifically, the cross section of the guide member 200 has a first dimension W2 in the direction facing the trigger wheel 110 or the guide wheel 120, and has a second dimension T2 in the radial direction of the trigger wheel 110 or the guide wheel 120. In its cross section, the guide member 200 may include a first surface 221 for contacting the trigger wheel 110 and a second surface 222 for contacting the guide wheel. The first surface 221 and the second surface 222 may be arranged to be mirror-symmetrical with respect to a first axis A2. The guide member 200 includes a plurality of bearing members 210, and the bearing members 210 are substantially uniformly distributed along the direction of the first dimension W2; in other words, they are arranged or provided along the first axis A2. A covering layer 220 is provided on the peripheries of the bearing members 210 to wrap each of the bearing members. In the illustrated embodiment, the bearing members 210 are arranged separately from each other, so the covering layer 220 is provided between the adjacent bearing members 210. The covering layer can transmit the force from the trigger wheel 110 and the guide wheel 120 to the bearing members, thereby preventing the movement of the body 100 relative to the bearing members.

In the embodiment shown in FIG. 3, the first surface 221 and the second surface 222 form a portion of the outer contour of the rectangular cross section, and therefore the first surface 221 and the second surface 222 are parallel to each other. In addition, the first surface 221 and the second surface 222 may have a flat or smooth shape. In addition, the second dimension T2 may be configured to be larger than or equal to 3 mm and smaller than 6 mm.

In the embodiment shown in FIG. 4, the guide member 300 includes a plurality of bearing members 310 and a covering layer 320 wrapping each of the bearing members 310. A first surface 321 and a second surface 322 of the guide member 300 include sections parallel to each other and curved transition sections. Therefore, the first surface 321 and the second surface 322 are not completely parallel, and the distance between the first surface 321 and the second surface 322 varies along a first axis A3. In the embodiment shown in FIG. 4, the first dimension W3 is larger than the second dimension T3, and the guide member 300 has a racetrack-shaped cross section. In addition, the second dimension T3 may be configured to be larger than or equal to 3 mm and smaller than 6 mm.

In the embodiment shown in FIG. 5, the guide member 400 includes a plurality of bearing members 410 and a covering layer 420 wrapping each of the bearing members 410. The distances from a first surface 421 and a second surface 422 of the guide member 400 to a first axis A4 is varied. More specifically, the distance between the first surface 421 and the second surface 422 is configured to vary along the first axis A4. In the embodiment shown in FIG. 5, the first dimension W4 is larger than the second dimension T4. In addition, the second dimension T4 may be configured to be larger than or equal to 3 mm and smaller than 6 mm.

The covering layer may be made of non-metallic materials and may be insulated. The bearing members may be made of metal or carbon fiber material. In an embodiment, the bearing members may be made of steel. In an embodiment, the covering layer may include rubber or plastic.

In an embodiment, the second dimension of the guide member may be configured to be 3 mm, 3.5 mm, 4 mm, 4.5 mm, 5 mm, 5.5 mm or 6 mm, for example.

The guide member 200 of the present application can provide greater friction than a conventional bearing member rope. In an embodiment, the guide member of the present application can provide a friction force 2-3 times that of the conventional bearing member rope. Therefore, regular functions of the governor assembly can be ensured.

When the guide member 200 is assembled with the trigger wheel 110 and the guide wheel 120, the surface on which the lengthwise dimension L is located is oriented toward the peripheral surfaces of the trigger wheel 110 and the guide wheel 120. That is, the lower surface of the guide member 200 in FIG. 3 will be oriented toward the peripheral surfaces of the trigger wheel 110 and the guide wheel 120.

By adopting the guide member 200 with a smooth surface, noises generated during operation will be effectively reduced.

The governor assembly and the elevator of the present application have the advantages of being simple, reliable, easy to implement, and convenient to use, etc. The dimension of the governor assembly is reduced and the operating noise is reduced.

This description discloses the present application with reference to the accompanying drawings, and also enables those skilled in the art to implement the present application, including manufacturing and using any device or system, selecting suitable materials, and using any combined method. The scope of the present application is defined by the claimed technical solutions, and contains other examples that can be conceived by those skilled in the art. Such other examples should be considered as falling within the scope of protection determined by the technical solutions claimed in the present application, as long as such other examples include structural elements that are not different from the literal language of the claimed technical solutions, or such other examples include equivalent structural elements that are not substantively different from the literal language of the claimed technical solutions.

What is claimed is:

1. A governor assembly, comprising:

a body equipping with a trigger wheel and a guide wheel, and the trigger wheel and the guide wheel being arranged to be rotatable relative to the body;

a guide member extending around the trigger wheel and the guide wheel in sequence; and wherein the guide member comprises a plurality of bearing members and a covering layer wrapping each of the bearing members, the bearing members arranged along a first axis;

wherein the covering layer defines a first surface in contact with the trigger wheel and a second surface in contact with the guide wheel;

wherein the cross section of the guide member has a first dimension in the direction facing the trigger wheel or the guide wheel, and has a second dimension in the radial direction of the trigger wheel or the guide wheel, and wherein the first dimension is larger than the second dimension;

wherein distances from the first surface to the second surface are configured to vary along the first axis, such that a first distance from the first surface to the second surface at a middle of the guide member is greater than a second distance from the first surface to the second surface at an outer edge of the guide member;

wherein the second distance is larger than or equal to 3 mm and smaller than 6 mm.

2. The governor assembly according to claim 1, wherein the covering layer is capable of transmitting the force from the trigger wheel and the guide wheel to the bearing members, such that the movement of the body relative to the bearing members is stopped.

3. The governor assembly according to claim 1, wherein the bearing members are made of one or more of the following materials: metal, carbon fiber.

4. The governor assembly according to claim 1, wherein the bearing members are arranged to be separated from each other, and the covering layer is provided between the adjacent bearing members.

5. The governor assembly according to claim 1, wherein the first surface and the second surface are configured to be symmetrical with respect to a first axis.

6. The governor assembly according to claim 1, wherein the direction in which the guide member surrounds the trigger wheel is opposite to the direction in which the guide member surrounds the guide wheel.

7. The governor assembly according to claim 1, wherein the trigger wheel and the guide wheel are configured to have a diameter larger than or equal to 90 mm and smaller than 180 mm.

8. An elevator comprising the governor assembly according to claim 1.

* * * * *